United States Patent [19]

Gamble

[11] Patent Number: 4,951,945

[45] Date of Patent: Aug. 28, 1990

[54] PLASTIC GOLF TEE

[76] Inventor: Robert M. Gamble, 450 N. Barfield Dr., Marco Island, Fla. 33937

[21] Appl. No.: 392,580

[22] Filed: Aug. 14, 1989

Related U.S. Application Data

[63] Continuation-in-part of Ser. No. 59,871, Jun. 8, 1987, Pat. No. D. 308,086.

[51] Int. Cl.[5] ..... A63B 57/00

[52] U.S. Cl. ..... 273/33

[58] Field of Search ..... 273/33, 202–212; D21/208

[56] References Cited

U.S. PATENT DOCUMENTS

| | | | |
|---|---|---|---|
| D. 232,568 | 8/1974 | Brown | 273/33 |
| 504,133 | 8/1893 | Parkinson | 273/33 |
| 1,623,782 | 4/1927 | Dent et al. | 273/33 |
| 1,638,527 | 8/1927 | Clausing | 273/211 |
| 1,645,001 | 10/1927 | Hodges | 273/211 |
| 1,864,516 | 6/1932 | Becket | 273/33 |
| 3,141,671 | 7/1964 | Eyer | 273/33 |
| 3,467,390 | 9/1969 | Gardiner | 273/202 |
| 3,747,927 | 7/1973 | Hoffmann | 273/33 |
| 3,947,027 | 3/1976 | Brown | 273/33 |

FOREIGN PATENT DOCUMENTS

| | | | |
|---|---|---|---|
| 601426 | 5/1948 | United Kingdom | 273/33 |

*Primary Examiner*—Theatrice Brown

*Attorney, Agent, or Firm*—William F. Hamrock

[57] ABSTRACT

The golf tee of the invention is formed from high impact plastic. It includes a sword shaped shaft and an enlarged triangular head integral therewith. The shaft has gradually tapering large, flat side surfaces large enough for markings thereon and forming a sharp front edge. The triangular shaped head includes a front apex and a slightly concaved area for supporting a golf ball. The upper rear of the shaft joins with the rear side of the triangular head to form a solid impact area.

9 Claims, 1 Drawing Sheet

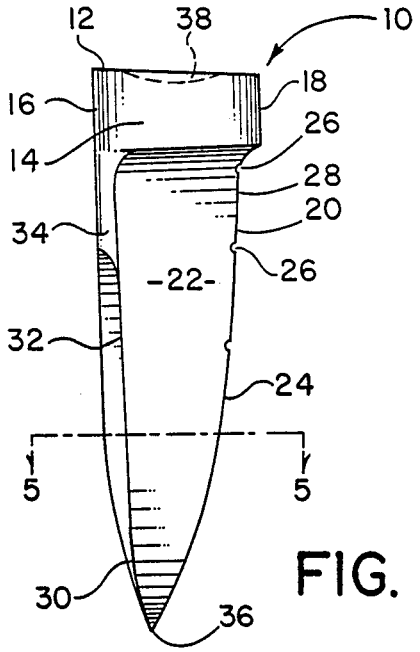
FIG. 1
FIG. 4
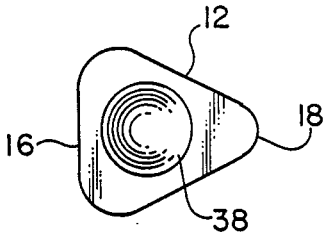
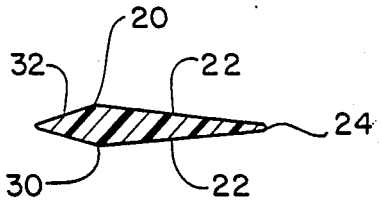
FIG. 5
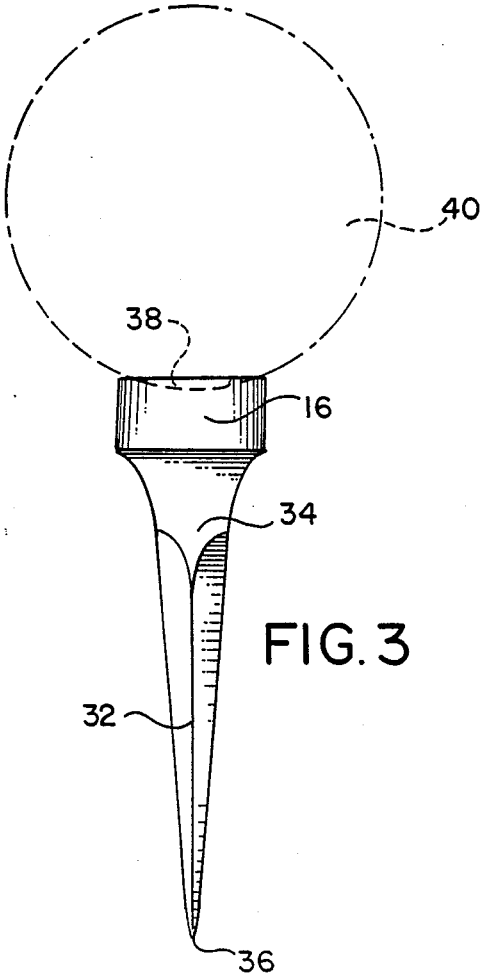
FIG. 3
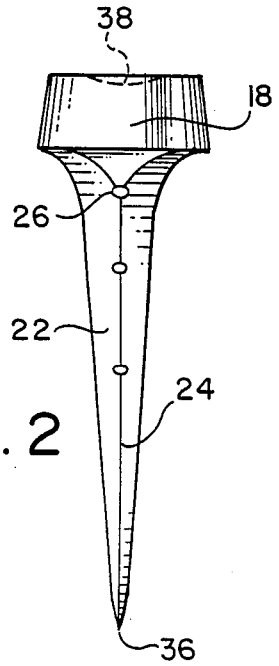
FIG. 2

PLASTIC GOLF TEE

RELATED APPLICATION

This application is a continuation-in-part of U.S. application Ser. No. 07/059871 filed June 8, 1987. (U.S. Pat. No. D308086)

BACKGROUND OF THE INVENTION

1. Field of the Invention

This invention relates to a golf tee and, in particular, to a golf tee which is durable, attractive, easily visible, pleasant to the touch, provides a surface for personal writing or advertising and which unexpectedly enables the striker of the golf ball to hit it farther than an identical ball hit in an identical way from a wooden tee.

2. Description of the Prior Art

Golf tees are well known. They are usually made from wood but have also been prepared from plastic, rubber and metal. Generally, they are formed from a single piece of material and have a very small upper concaved surface for supporting the ball and a very thin tapered shank pinpointed at the base for penetrating the ground in the tee box. Wooden golf tees are easily broken and/or lost. It is estimated that 3–5 wooden tees are broken or lost in every 18 hole round of golf.

This existing condition results in cluttering the golf course in the vicinity of the teeing area. There has been very little consideration paid to improving this negative situation which can also contribute to damage to mowers. For a number of reasons, very little attention has been paid to providing attractive, durable golf tees that do not break easily and yet are easily seen from a reasonable distance. There has also been very little regard paid to having one's personalized printed golf tees or golf tees containing advertisements, other than one line of small type imprinted on the stem of a wooden tee and which is barely readable. In many instances, it would be desirable to have golf tees that are attractive, durable, and large and bright enough to be easily seen at a reasonable distance. In many other instances, it would be preferable to have personalized golf tees containing one's name or other personal marking or to have an advertisement thereon. Also, it would be imperative that a golf tee possessing the above qualities would perform just as effectively as conventional golf tees. It would be important likewise that the use of such a golf tee would not violate the rules of Golf promulgated by the United States Golf Association (USGA).

Thus, a need exists for golf tees that are attractive, durable, bright and large enough to be easily seen within a reasonable distance, and of such structure that a design, name, personal marking or advertisement can be placed thereon. Such golf tees must be at least as effective as conventional golf tees must be and not violate the Rules of golf. It is to such golf tees that the instant invention is directed.

SUMMARY OF THE INVENTION

Accordingly, it is a principle object of the present invention to provide golf tees which cause less friction to the ball when leaving the tee, enabling it to be hit farther than from a wooden tee.

It is another object of the present invention to provide golf tees which give better directional control.

It is a further object of the present invention to provide golf tees which are extremely durable and are clearly visible over greater distances.

It is another further object of the present invention to provide golf tees having an attractive modern, aerodynamic design.

It is another further object of the present invention to provide golf tees which will not mar or damage the clubhead face.

It is another further object of the present invention to feel good to the touch of the user similar to lucky stones, steel balls, etc.

It is another further object of the present invention to provide golf tees which can be useful in many other situations on the golf course.

These and other objects of the invention are achiedved by providing a glossy, bright golf tee made of high impact plastic, such as high density polyethylene, comprising a triangular shaped head with its front apex pointing towards the target and having a slightly concaved area to hold the ball causing less friction to the ball, a sword shaped shaft wide enough for writings, printings or markings thereon and having its front edge sharpened in order to move forward in the ground, the upper rear of the shaft joining with the rear side of the rectangular head forming a solid impact area, the bottom of the shaft having a sharpened point for easy insertion in the properly prepared tee box areas, and smooth tapering areas for less resistance upon insertion.

Other objects and advantages of this invention will become apparent upon referring to the detailed description which follows, taken in conjunction with the drawings.

BRIEF DESCRIPTION OF THE DRAWINGS

FIG. 1 is a side view of the golf tee.
FIG. 2. is a front view of the golf tee.
FIG. 3. is a rear view of the golf tee.
FIG. 4. is a top view of the golf tee.
FIG. 5. is a cross sectional view of 5—5.

DETAILED DESCRIPTION OF THE INVENTION

FIGS. 1–5 illustrate a preferred embodiment of the invention. FIG. 1 depicts a side view of golf tee 10 which is about three inches high and can be formed from a high impact molded plastic such as high density polyethylene. Shown in FIG. 1 is the triangular head 12 including side apron 14, flat rear side 16 and apex 18. Shaft 20 resembles a sword and has a large flat surface 22, sharpened curved front 24 having three notches 26 progressing upwardly from about one and one half inch from the bottom and being about one half an inch apart. The uppermost surface 28 of shaft 22 tapers upwardly joining side apron 14 of triangular head 12. Ridge line 30 crests at the juncture of tapering rear shoulder 32 and flat surface 22 of the shaft. The upper rear section 34 of shaft 20 forms a relatively flat surface with the flat rear side 16 of the triangular head. Progressing downwardly along a sharpened rear blade the golf tee forms a sharpened point 36 at the bottom of the tee. Cavity 38 is shown located in the triangular head.

FIG. 2. illustrates a front view of the golf tee showing the pointed base 36, sharpened front edge 24, notches 26, apex 18 and ball cavity 38. The sharpened bottom allows the tee to be inserted easily into a teeing ground which has been properly prepared. Notches 26 help to identify the height of the tee after insertion into the ground. When inserted to the lowest notch the tee is about one and one-half inches above the ground and when inserted to the highest notch the tee is about one half inch above the ground. Sharpened front edge 24 provides for the tee to be easily moved forward through the ground upon impact from the player's club. The small and shallow cavity 38 permits the ball to be placed thereon without hazard of ball rolling off the Tee before being struck by the club. Apex 18 is pointed in the direction of the target to remind players of the direction of the flight of the ball. Small and shallow ball cavity largely eliminates friction to flight of ball when struck by club adding distance to the flight.

A rear view of the golf tee is depicted in FIG. 3. illustrating pointed base 36, rear shoulder or blade 32, upper rear shaft 34, rear flat side 16 of triangular head 12 and small ball cavity 38. The narrow rear shoulder or blade 32 assists in allowing the tee to be moved forward through the ground upon impact with the club and also permits an increased flat surface for shaft surface 22. The upper rear shaft surface 34 and triangular head rearside 16 form a solid impact area for striking with the club head. The smallness of ball cavity 38, having diameter of about 0.3 inch or less and a depth of about 0.06 inch or less, results in less friction to the ball 40, shown in place. The clubhead speed not only transfers directly to the ball in compressing it, but through the tee also compressing it, then to the ball in milliseconds giving the clubhead mass a powerful one-two punch thus creating a mighty launching pad, with a forward and upward thrust to the ball for greater distance and lift than from a wooden tee.

A top view of the triangular head surface 12 is depicted on FIG. 4. The triangular head is about 13/16 inch from the center point of the rear side to the front apex, and about 11/16 inch at its widest point. FIG. 5. shows a cross section through lines 5-5 of FIG. 1. indicating the wide sloping flat surface 22 and the narrow sloping shoulder 32 of shaft 20.

The golf-tee of the present invention solves many problems associated with conventional tees which are either broken or lost or just left by thoughtless golfers after striking the ball and remain on the golf course to litter the ground and damage groundskeeping mowing equipment.

The following advantages are obtained by using the present golf tee.

The smaller ball cavity causes less friction to the ball enabling it to be hit farther, Energy created by the clubhead speed in compressing the ball not only transfers directly to the ball but also through the tee to the ball giving the clubhead mass a powerful one two punch for greater distance and lift. It gives better directional control because of minimal friction of the ball cavity plus arrow direction which gives golfer a mental and psychological advantage in hitting the ball straighter to the target. It produces a good solid feeling when hitting the ball. It is virtually indestructible and unloseable and consequently no littering or mowing equipment damage. It floats in water which is especially important in courses with many water holes, It will not mar or damage the clubhead face because of its soft plastic construction. It will not prick a person's thigh when carried in one's pocket. It feels good to the finger's touch much like lucky stones; Chinese steel balls, etc. It is an ideal greens tool for pecking ball and spike marks, and then smoothing them with its broad blade. It is good for cleaning spikes, shoes, soles and clubhead grooves without scratching as metal tools may do. It is an excellent resting tool for supporting club grips on wet or damp greens or fairways thereby keeping them dry. It is less expensive over a period of time than all other tees because of its proven longevity.

In recent tests conducted at New York University's Physics Department, it was shown conclusively that a ball struck from the present golf tee will travel farther than an identical ball struck in an identical way from a wooden tee. It is suggested that the reason for this is that there appears to be two contributions to the force of the ball. The first force is from the club to the ball and a second force on the ball which arises from the rapid compression and subsequent expansion of the tee. This second force, which is non-existant when a wooden tee is used, adds to the first force and increases the magnitude of the resultant force on the ball. This second force probably increases the vertical component of the total force, giving rise to increased lift of the ball.

Further, it will be apparent to those skilled in the art from the foregoing description and accompanying drawings that additional modifications and/or changes of the disclosed embodiments may be made without departure from the invention. Accordingly, it is expressly intended that the foregoing description and accompanying drawings are illustrative of preferred embodiments only, not limiting, and that the true spirit and scope of the present invention be determined by reference to the appended claims.

I claim:

1. A golf tee formed from a high impact plastic comprising a sword shaped shaft having an enlarged triangular head integral therewith, said triangular head having an upper flat surface with a slightly concaved area located therein, for supporting a golf ball, side aprons connecting to form a front apex and a flat rear side, said shaft projecting downwardly from said triangular head and forming a pointed base for inserting into the teeing ground, wherein said tee is about three inches in height, and said triangular head is about 13/16 inch from the center of the rear side to the front apex, and about 11/16 inch at its widest point.

2. A golf tee according to claim 1 wherein said shaft comprises a sharpened front edge, a sharpened lower rear edge tapering upwardly into a flat rear section integral with said flat rear side of said triangular head.

3. A golf tee according to claim 2 wherein said shaft has a gradually tapering large flat side surface.

4. A golf tee according to claim 3 wherein said flat side surface provides a surface for printing, writing and marking.

5. A golf tee according to claim 2, wherein said concaved area is located towards the rear of the triangular head.

6. A golf tee according to claim 5 wherein said plastic is high density polyethylene.

7. A golf tee according to claim 1 wherein said concaved area is located about an eight of an inch in from said side aprons and said rear side surface of said triangular head.

8. A golf tee formed from a high impact plastic comprising a sword shaped shaft having an enlarged triangular head integral therewith, said triangular head having an upper flat surface with a slightly concaved area located therein for supporting a golf ball, side aprons connecting to form a front apex, and a flat rear side, said shaft projecting downwardly from said triangular head and forming a pointed base for inserting into the teeing ground, said shaft comprises a sharpened front edge, a sharpened lower rear edge tapering upwardly into a flat rear section integral with the flat rear side of said triangle, and gradually tapering large flat surface, wherein said concaved area is located toward the rear of said triangular head, and wherein said tee is about three inches in height, and said triangular head is about 13/16 inch from the center of the rear side to the front apex, and about 11/16 inch at its widest point.

9. A golf tee according to claim 8 wherein said plastic is high density polyethylene.

* * * * *